US009728863B2

(12) United States Patent
Legay et al.

(10) Patent No.: US 9,728,863 B2
(45) Date of Patent: Aug. 8, 2017

(54) POWER SPLITTER COMPRISING A TEE COUPLER IN THE E-PLANE, RADIATING ARRAY AND ANTENNA COMPRISING SUCH A RADIATING ARRAY

(71) Applicant: THALES, Neuilly-sur-Seine (FR)

(72) Inventors: Herve Legay, Plaissance du Touch (FR); Adrien Cottin, Rennes (FR); Ronan Sauleau, Acigne (FR); Patrick Potier, Bruze (FR); Pierre Bosshard, Tournefeuille (FR)

(73) Assignee: THALES, Courbevoie (FR)

( * ) Notice: Subject to any disclaimer, the term of this patent is extended or adjusted under 35 U.S.C. 154(b) by 256 days.

(21) Appl. No.: 14/530,709

(22) Filed: Nov. 1, 2014

(65) Prior Publication Data

US 2015/0123867 A1 May 7, 2015

(30) Foreign Application Priority Data

Nov. 4, 2013 (FR) ..... 13 02549

(51) Int. Cl.
*H01P 5/12* (2006.01)
*H01Q 21/00* (2006.01)
(Continued)

(52) U.S. Cl.
CPC ..... *H01Q 21/0006* (2013.01); *H01P 1/161* (2013.01); *H01P 5/12* (2013.01);
(Continued)

(58) Field of Classification Search
CPC ..... H01P 5/12; H01P 5/16; H01P 5/20; H01P 1/161; H01C 21/0006; H01C 1/228; H01C 25/007
(Continued)

(56) References Cited

U.S. PATENT DOCUMENTS 2,540,839 A 2/1951 Southworth
6,037,910 A 3/2000 Solbach et al.

FOREIGN PATENT DOCUMENTS

DE 19636850 A1 3/1998
EP 0 577 320 A1 1/1994
(Continued)

OTHER PUBLICATIONS

Walter Steffe, "A Novel Compact OMJ for Ku Band Intelsat Applications," IEEE Antennas and Propagation Society International Symposium Digest, Jun. 1995, vol. 1, pp. 152-155, XP000586859.

*Primary Examiner* — Robert Pascal
*Assistant Examiner* — Kimberly Glenn
(74) *Attorney, Agent, or Firm* — Baker & Hostetler LLP

(57) ABSTRACT

A power splitter comprises at least two mutually parallel lateral waveguides with rectangular cross-section and a transverse waveguide with rectangular cross-section comprising two opposite ends respectively connected to the two lateral waveguides. The two lateral waveguides are oriented along a direction Y and mounted flat with their large side parallel to a plane XY, the transverse waveguide is oriented along a direction X perpendicular to the direction Y and mounted edgewise with its small side parallel to the plane XY, and each lateral waveguide is coupled to the transverse waveguide by a tee coupler in the E-plane with embedded junction, the two ends of the transverse waveguide being respectively embedded in each lateral waveguide, at the center of the said respective lateral waveguide.

10 Claims, 15 Drawing Sheets

(51) Int. Cl.

| | |
|---|---|
| ***H01P 1/161*** | (2006.01) |
| ***H01Q 1/28*** | (2006.01) |
| ***H01Q 25/00*** | (2006.01) |
| ***H01P 5/16*** | (2006.01) |
| *H01P 5/20* | (2006.01) |

(52) U.S. Cl.
CPC ..... *H01P 5/16* (2013.01); *H01Q 1/288* (2013.01); *H01Q 25/007* (2013.01); *H01P 5/20* (2013.01)

(58) Field of Classification Search
USPC ..... 333/125
See application file for complete search history.

(56) References Cited

FOREIGN PATENT DOCUMENTS

| | | | | |
|---|---|---|---|---|
| EP | 2290744 | A1 | 3/2011 | |
| FR | 890 388 | A | 2/1944 | |
| GB | 1310534 | A | 3/1973 | |
| KR | WO 2009031794 | A1 * | 3/2009 | ..... H01Q 13/0258 |
| WO | 2013089456 | A1 | 6/2013 | |

* cited by examiner

POWER SPLITTER COMPRISING A TEE COUPLER IN THE E-PLANE, RADIATING ARRAY AND ANTENNA COMPRISING SUCH A RADIATING ARRAY

CROSS-REFERENCE TO RELATED APPLICATION

This application claims priority to foreign French patent application No. FR 1302549, filed on Nov. 4, 2013, the disclosure of which is incorporated by reference in its entirety.

FIELD OF THE INVENTION

The present invention relates to a power splitter comprising a Tee coupler in the E-plane, a radiating array and an antenna comprising such a radiating array. It applies to the sector of multibeam antennas with focal array operating in low frequency bands and more particularly to the sector of C-band, L-band or S-band telecommunications. It also applies to the radiating elements for array antennas notably in the X-band or the Ka-band, as well as for a spatial antenna of global coverage, notably in the C-band.

BACKGROUND

A Tee coupler is a junction between three waveguides arranged in the form of a T, the three waveguides each comprising an end forming an input or output port of the coupler. The Tee junction can be of two different types, called a junction in the E-plane or in the H-plane, depending on the arrangement of the waveguides forming the three arms 10, 20, 30 of the T with respect to the electric field E and to the magnetic field H propagating in the waveguides. In a known manner, when an electromagnetic wave propagates in a rectangular waveguide, the electric field E extends along a direction perpendicular to the large sides of the waveguide and the magnetic field H extends along a direction parallel to the large sides of the waveguide.

The Tee coupler most commonly used for power splitters in waveguide technology is the H-plane Tee junction represented schematically in FIG. 1*a*. The waveguides have rectangular cross-section, each waveguide being delimited by a peripheral metallic wall consisting of two large sides, of two small sides and comprising an input or output port. The three input and output waveguides 10, 20 and 30 are mounted flat on their large side and extend in one and the same plane XY, the input waveguide 30 being perpendicular to the two lateral output waveguides 10 and 20. The junction is said to be in the H-plane since the output ports 11, 21 of the two lateral waveguides 10 and 20, which form the horizontal bar of a T, are oriented in the same plane XY as the H-field established in the input port 31 of the input waveguide 30.

The Tee junction in the H-plane is frequently used in a waveguide splitting array to connect the two output ports 11, 21 to two radiating elements 12, 22, such as for example compact horns, the assembly forming a radiating array which can be used in a planar antenna. The radiating array represented in FIG. 1*b* comprises an H-plane Tee junction mounted parallel to the plane XZ and two radiating horns oriented along the axis Z and connected to the two output ports of the Tee junction. For bulkiness reasons, in particular for the low frequency bands, it may be desired that the splitting array be situated in the plane XY thereby making it possible to reduce the thickness of the splitting array along the direction Z. In this case, the radiating elements can be fed by the splitting array by way of an electromagnetic coupling slot 13, 23 as shown by FIG. 1*c*. This coupling technique is sensitive to the direction of propagation of the incident electromagnetic wave. If the two radiating elements 12, 22 are excited by electromagnetic waves propagating in opposite directions, then they radiate in phase opposition. The splitting array must then compensate for this difference of excitation phase. If this splitting array consists of a Tee junction in the H-plane, so that the radiating elements are excited in phase by one and the same feed source and radiate in a coherent manner, it is necessary to add a stub 14, consisting of a waveguide segment, having a length equal to a guided half-wavelength, on one of the two output ports 11 or 21. This waveguide segment 14 carries out a phase inversion of 180° which compensates for the phase difference due to the excitation by an electromagnetic slot. This additional waveguide segment increases the distance between two radiating elements, as shown by the example of FIG. 1*c* in which the radiating array comprises an H-plane Tee junction oriented parallel to the plane XY and two radiating elements of horn type oriented along the direction Z. Moreover, the power splitter thus formed is dissymmetric, this being prejudicial to the passband performance of the radiating array.

To excite the radiating elements in phase with a symmetric and compact splitting array, it is then necessary to have a Tee coupler in the E-plane, as shown by FIGS. 2*a* and 2*b*. The Tee coupler in the E-plane represented schematically in FIG. 2*a* makes it possible to excite two radiating elements in phase, without requiring an additional waveguide segment. In this Tee junction in the E-plane, the two lateral waveguides 10 and 20 are mounted flat on their large side one behind the other along one and the same direction X of the plane XY and the input waveguide 30 is coupled perpendicularly to the two lateral waveguides 10 and 20 and extends along a direction Z perpendicular to the plane XY. The junction is said to be in the E-plane since the two output ports 11, 21 at the ends of the two lateral waveguides 10, 20 which form the transverse bar of a T are in the same plane XY as the field E established in the input port of the input waveguide 30. However, this known Tee junction is characterized by an input port 31 disposed along a direction Z normal to the plane XY formed by the large sides of the rectangular output guides. This disposition increases the bulkiness of the coupler in terms of height and the bulkiness of a power splitter and of a planar antenna comprising such a Tee coupler in the E-plane and radiating elements 12, 22 coupled to this power splitter by way of the respective coupling slots 13, 23.

As represented in FIG. 3, it is also possible to achieve a Tee coupler in the E-plane by mounting the input waveguide 30 and the two lateral output waveguides 10, 20 flat on two distinct stages overlaid one above the other, the large sides of all the waveguides 10, 20, 30 being parallel to the plane XY. In this case, the two lateral output waveguides are replaced with a single waveguide 40 linking the two output ports 11, 21. If the input waveguide 30 is disposed at the lower stage and the output waveguide 40 is situated at the upper stage, the coupling in the E-plane takes place by devising a slot 35 at the end of the input waveguide 30, in the upper wall, and a corresponding slot at the centre of the lower wall of the output waveguide 40 linking the two output ports. The coupling between the input port 31 and the output ports 11, 21 being in the E-plane, the two output ports 11, 21 can be connected to two radiating elements so that they radiate in phase coherence. It is thus not necessary to add a waveguide segment on one of the output ports, thereby improving the compactness of the power splitter obtained. However, to excite the lateral waveguides in a symmetric manner, it is necessary for the coupling slots to be made in the input waveguide in a dissymmetric manner. In particular, in FIG. 3, the coupling slot is disposed at the edge of the input waveguide and not at the centre. This therefore results, as in the case of a tee coupler in the H-plane, in a dissymmetry of the power splitter. This dissymmetry results in an unbalanced coupling between the output ports and also alters the passband of the antenna obtained. It is also detrimental to the compactness of the radiating array.

SUMMARY OF THE INVENTION

The aim of the invention is to solve the problems of existing power splitters and to propose a new power splitter in waveguide technology comprising a Tee coupler in the E-plane that is perfectly symmetric and more compact in terms of height, making it possible to feed radiating elements in phase without adding a stub, and thus being able to help reduce the bulkiness of the power splitters used in arrays of radiating elements in low frequency bands, such as in the C, L, or S bands.

Therefore, the invention relates to a power splitter comprising at least two mutually parallel lateral waveguides with rectangular cross-section and a transverse waveguide with rectangular cross-section comprising two opposite ends respectively connected to the two lateral waveguides. The two lateral waveguides are oriented along a direction Y and mounted flat with their large side parallel to a plane XY, the transverse waveguide is oriented along a direction X perpendicular to the direction Y and mounted edgewise with its small side parallel to the plane XY. Each lateral waveguide is coupled to the transverse waveguide by a tee coupler in the E-plane with embedded junction, the two ends of the transverse waveguide being respectively embedded in each lateral waveguide, at the centre of the said respective lateral waveguide.

Advantageously, the two lateral waveguides can each comprise two opposite ends constituting four input/output ports and the transverse waveguide comprises a central feed port.

According to one embodiment, at the level of each embedded junction, the transverse waveguide can comprise an external cavity furnished with an absorbent film and a coupling slot emerging into the external cavity.

The invention also relates to a radiating array comprising at least one power splitter and four radiating elements respectively coupled to the four ports of the power splitter.

The invention also relates to a beamforming antenna comprising at least one radiating array.

According to one embodiment, the beamforming antenna comprises at least two power splitters disposed parallel to one another and linked together along the direction Y of the lateral waveguides of the two power splitters by orthomode transducers OMT and radiating elements respectively coupled to output ports of respective orthomode transducers.

According to another embodiment, the beamforming antenna comprises at least two power splitters disposed perpendicular to one another and linked together by orthomode transducers OMT and radiating elements respectively coupled to output ports of respective orthomode transducers.

Advantageously, the beamforming antenna can furthermore comprise at least one reflector and at least two adjacent identical radiating arrays mounted in front of the reflector, the two adjacent radiating arrays being dedicated to two mutually orthogonal different polarizations.

Advantageously, the beamforming antenna comprises at least four power splitters as well as power combining/dividing means connected between the ports of the power splitters and input ports of each OMT, the power splitters being linked together pairwise along two orthogonal directions X, Y of a plane XY.

Advantageously, the power combining/dividing means comprise Tee couplers in the E-plane with embedded junction with four ports, the four ports consisting of two input ports oriented along the direction X and of two output ports oriented along the direction Y, three ports linking, along the direction Y, the lateral waveguides to the transverse waveguide of a first power splitter, the fourth port linking, along the direction X, the transverse waveguide of the first power splitter to a transverse waveguide of a second adjacent power splitter.

BRIEF DESCRIPTION OF THE DRAWINGS

Other particular features and advantages of the invention will become clearly apparent in the subsequent description given by way of purely illustrative and nonlimiting example, with reference to the appended schematic drawings which represent.

DETAILED DESCRIPTION

Figure 1A:
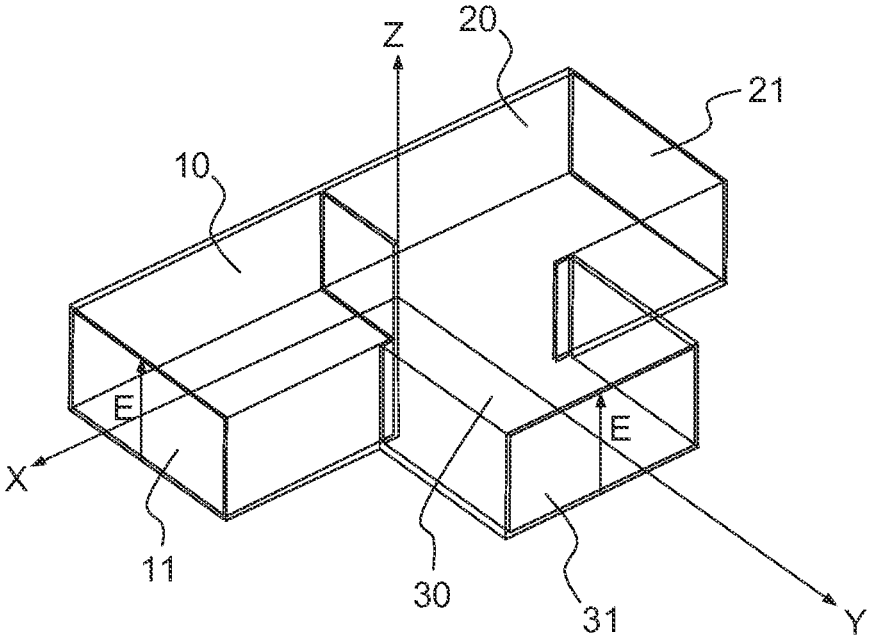
FIG. 1*a*: a perspective diagram of an exemplary Tee coupler in the H-plane, according to the prior art.
Figure 1B:
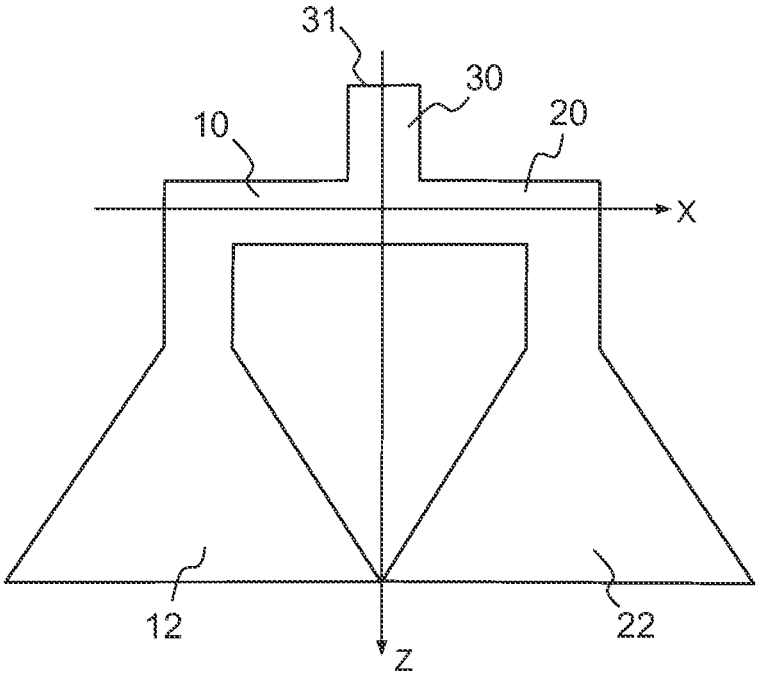
FIG. 1*b*: a sectional diagram of an exemplary radiating array comprising the Tee coupler in the H-plane of FIG. 1*a* mounted parallel to the plane XZ of the radiating array, according to the prior art.
Figure 1C:
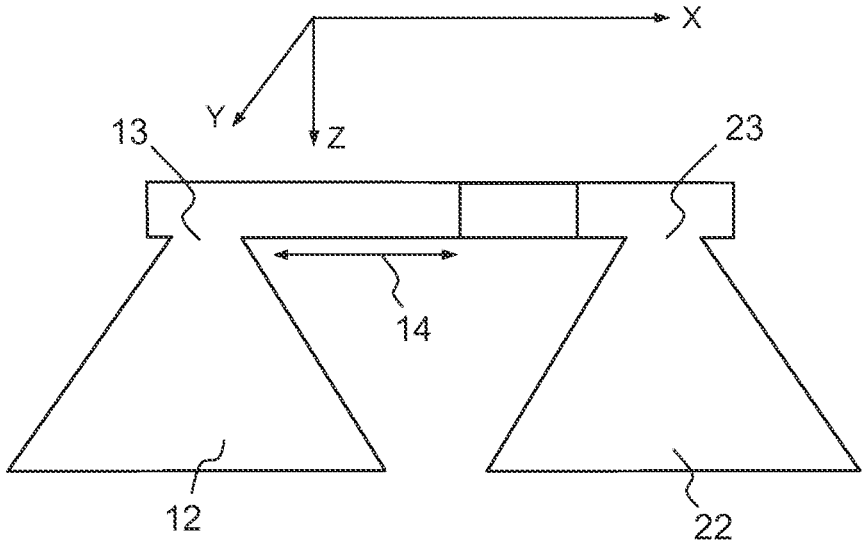
FIG. 1*c*: a sectional diagram of an exemplary radiating array comprising the Tee coupler in the H-plane of FIG. 1*a* mounted parallel to the plane XY of the radiating array, according to the prior art.
Figure 2A:
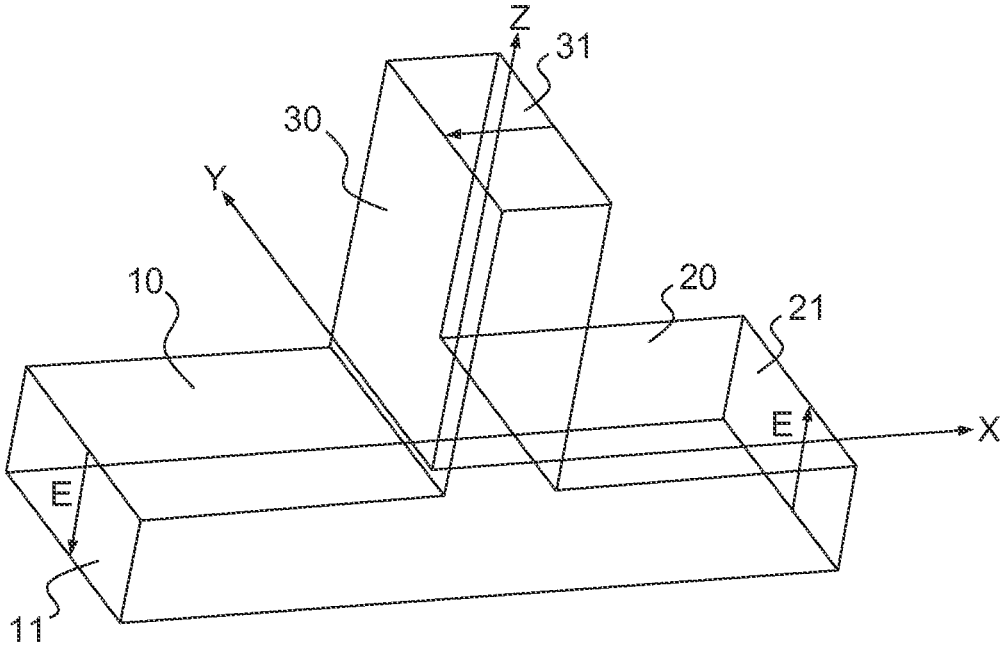
FIG. 2*a*: a perspective diagram of a first exemplary Tee coupler in the E-plane, according to the prior art.
Figure 2B:
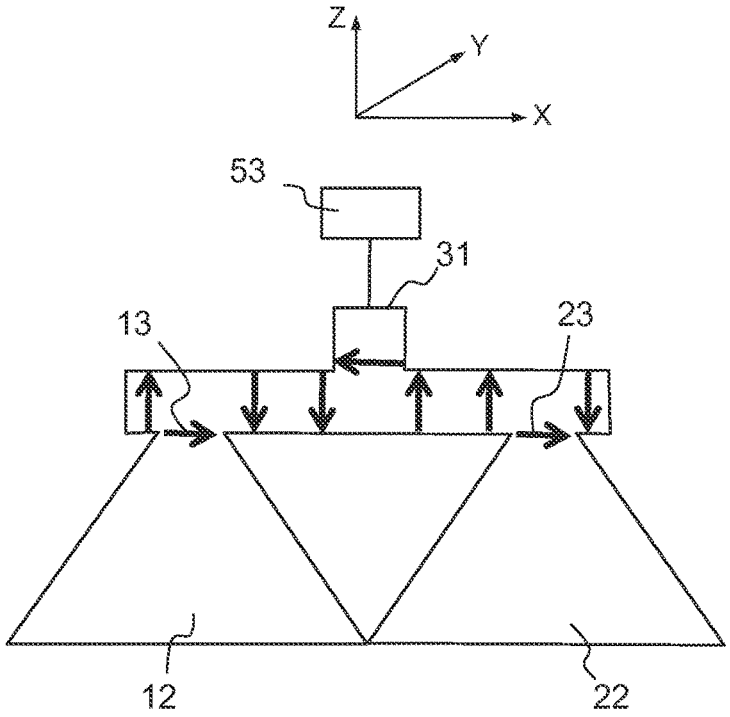
FIG. 2*b*: a sectional diagram of an exemplary radiating array comprising the Tee coupler in the E-plane of FIG. 2*a* oriented along the plane XY, according to the prior art.
Figure 3:
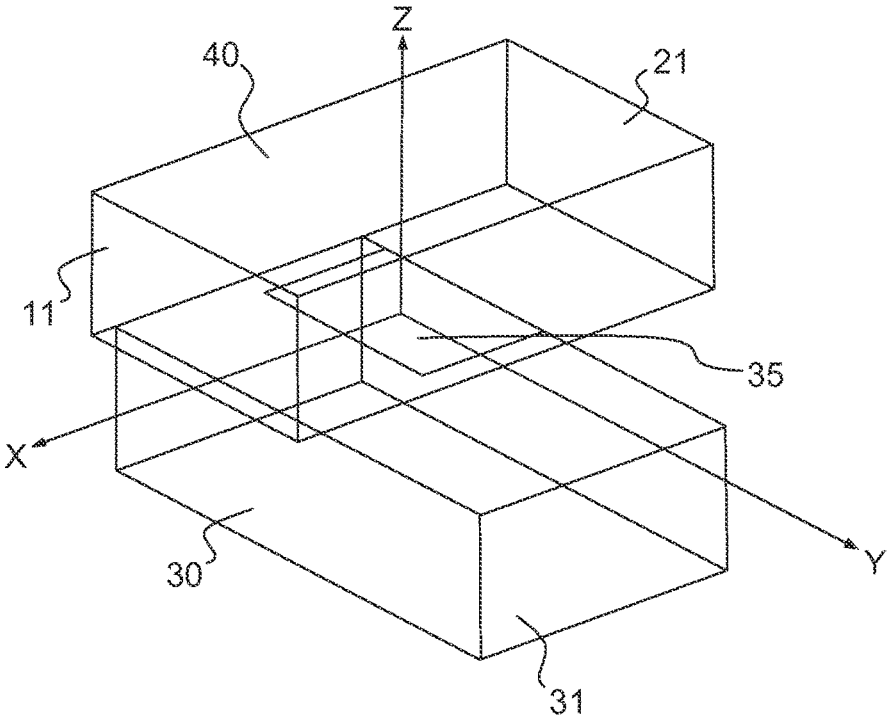
FIG. 3: a perspective diagram of a second exemplary Tee coupler in the E-plane, according to the prior art.
Figure 4A:
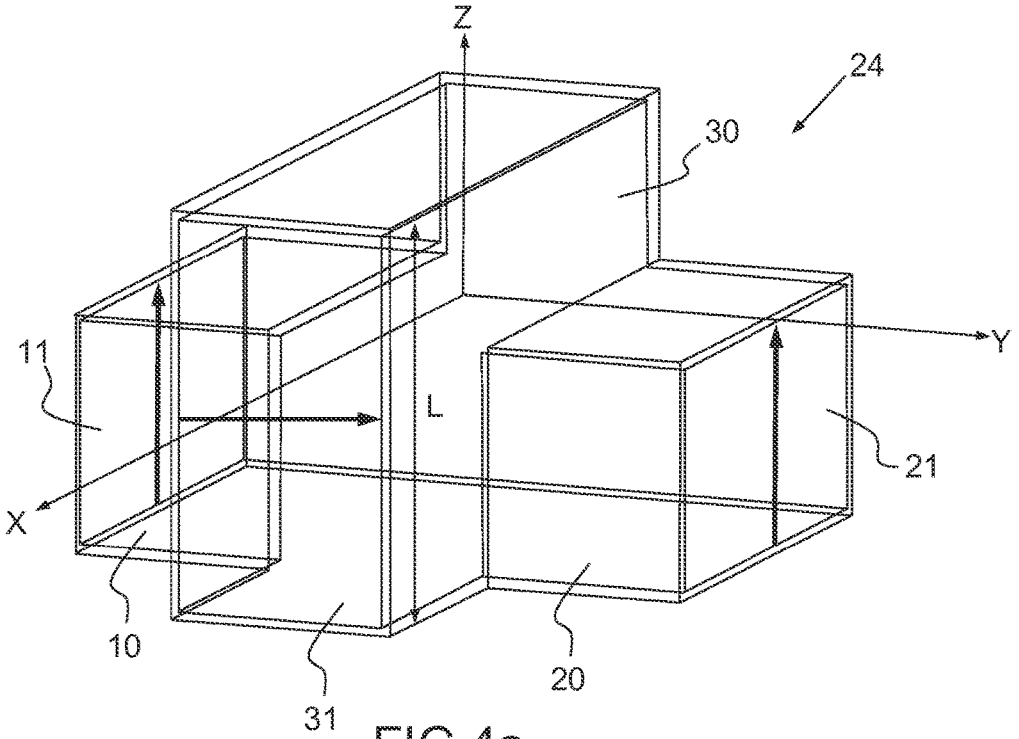
FIG. 4*a*: a perspective diagram of an exemplary Tee coupler in the E-plane with embedded junction with three ports, according to the invention.

FIG. 4*a* represents an exemplary Tee coupler in the E-plane according to the invention. The Tee coupler comprises an embedded junction and can comprise three or four input/output ports. In FIG. 4*a*, the Tee coupler 24 comprises three waveguides 10, 20, 30, each waveguide being delimited by a peripheral metallic wall consisting of two large sides, of two small sides and comprising an input or output port 11, 21, 31. Two lateral waveguides 10 and 20 are mounted flat on their large side and a central waveguide 30 is mounted edgewise on its small side, and embedded between the two lateral waveguides 10, 20. Thus, the lateral waveguides 10, 20 have their walls of larger width parallel to the plane XY, whereas the central waveguide 30 has its walls of larger width perpendicular to the plane XY. All the waveguides and all the input and output ports are therefore parallel to the plane XY, but the longitudinal axis of the central waveguide 30 is oriented along the direction X perpendicularly to the longitudinal axes of the two lateral waveguides 10, 20 which are oriented along the direction Y. The embedding of the central waveguide 30 between the two lateral waveguides 10, 20 makes it possible to limit the thickness of the coupler to the width L of a large side of the central waveguide 30. The ends of the lateral waveguides 10, 20 form two lateral, output or input, ports 11, 21 oriented along the direction Y and one of the ends of the central waveguide 30 forms an input port, or output port, 31 oriented along the direction X perpendicular to the direction Y. The three waveguides being disposed in one and the same plane XY. The structure of the coupler is then perfectly symmetric, the input/output ports of the lateral waveguides are disposed symmetrically with respect to the input/output port of the central waveguide, and the couplings of the port 31 of the central waveguide to the two ports 11, 21 of the two lateral waveguides are perfectly balanced. The junction of this Tee coupler in the E-plane being embedded, this Tee coupler exhibits the advantage of being perfectly symmetric, simpler to achieve and makes it possible to achieve a more compact symmetric power splitter than all the known power splitters. To adapt the two ports 11, 21 of the two lateral waveguides, it is necessary for the cross-sections of the lateral waveguides 10, 20 to be less wide than the cross-section of the central waveguide 30.

Figure 5:
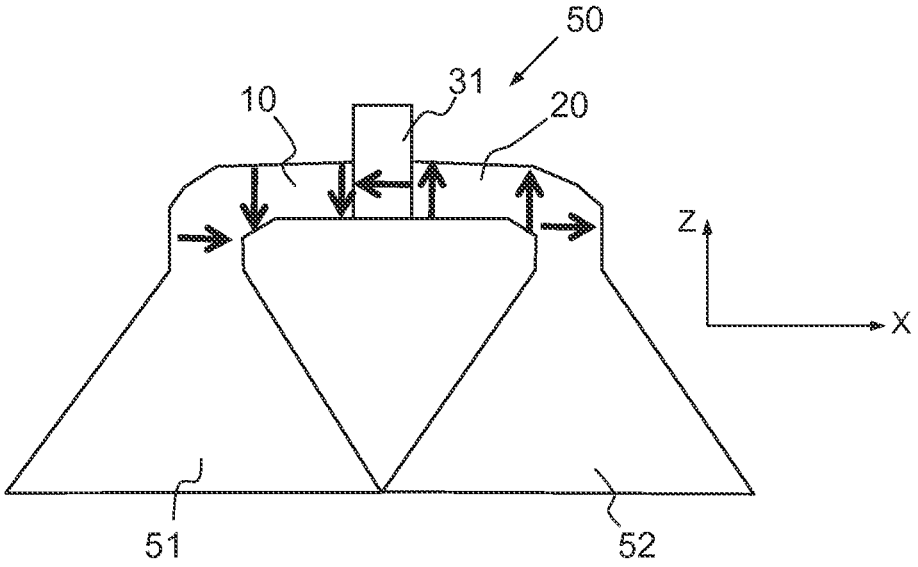
FIG. 5: a sectional diagram along the plane YZ, of an exemplary radiating array using a Tee coupler in the E-plane, according to the invention.

The Tee coupler in the E-plane with embedded junction 24 forms a symmetric power splitter between an input/output port 31 of the central waveguide and two output/input ports 11, 21 of the lateral waveguides and can be used to feed in phase two different radiating elements of a radiating array 50 as represented for example in FIG. 5. Two radiating elements 51, 52, for example horns or radiating cavities such as Fabry-Perot cavities, can be coupled to the two ports 11, 21 of the lateral waveguides 10, 20 of the coupler in the E-plane with embedded junction and be fed in phase by a feed source 53 connected to the port 31 of the central waveguide 30. The link between each lateral port 11, 21 and the two corresponding radiating elements, can be achieved through a bent waveguide. The two radiating elements 51, 52 connected in an array by the Tee coupler in the E-plane form a radiating array 50 which can be used, alone or in combination with other arrayed radiating elements, in a planar antenna operating in transmission or in reception.

Figure 4B:
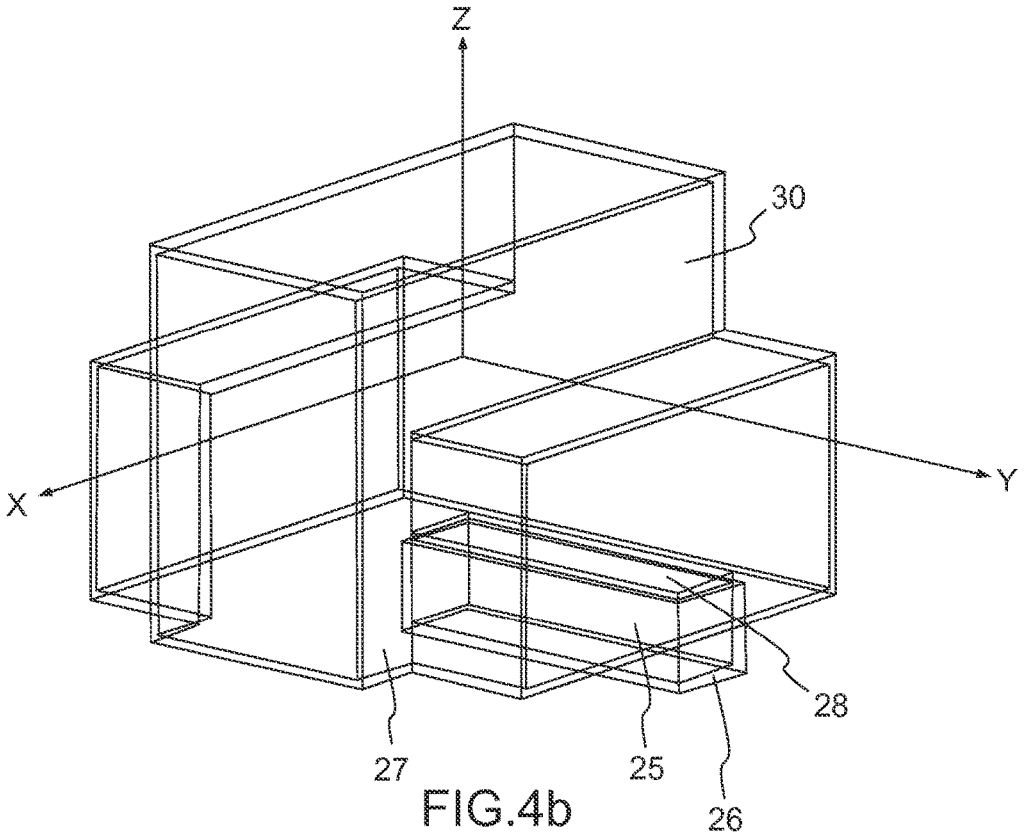
FIG. 4*b*: a perspective diagram of a Tee coupler in the E-plane with embedded junction with three ports comprising an absorbent cavity, according to the invention.

The Tee coupler 24 with embedded junction and comprising three ports represented in FIG. 4*a* is sensitive in terms of matching to the phase coherence of the incident signals on the two ports 21 and 11 of the lateral waveguides when the power splitter operates in reception. If the incident signals are no longer in phase opposition, as is the case for example for the signals received by the radiating elements for an incident wave with a direction not normal to the surface of the array, then the signals are slightly unbalanced in phase. This may result in a mismatching of the Tee coupler with three ports, injurious to the radiating pattern of the radiating array. In this case, as represented in FIG. 4*b*, the Tee coupler 24 with embedded junction with three ports can comprise a cavity 25 in the bottom of which is deposited an absorbent film 26. The cavity furnished with the absorbent film can for example be made under the lower wall 27 of the central waveguide 30 of the coupler 24 and is fed by a longitudinal slot 28 made in the said lower wall 27. The cavity 25 furnished with the absorbent film 26 makes it possible to absorb the electromagnetic waves which propagate in the power splitter and which do not comply with the phase conditions necessary for the operation of the Tee coupler in the E-plane.

Figure 6A:
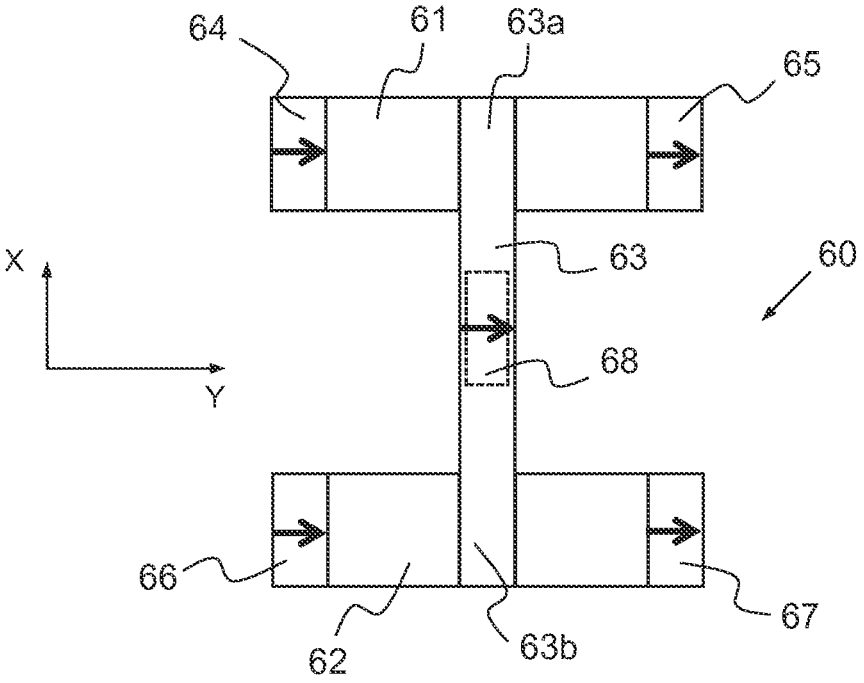
FIG. 6*a*: a schematic view from above of an exemplary power splitting array with four ports comprising two Tee couplers in the E-plane, according to the invention.
Figure 13:
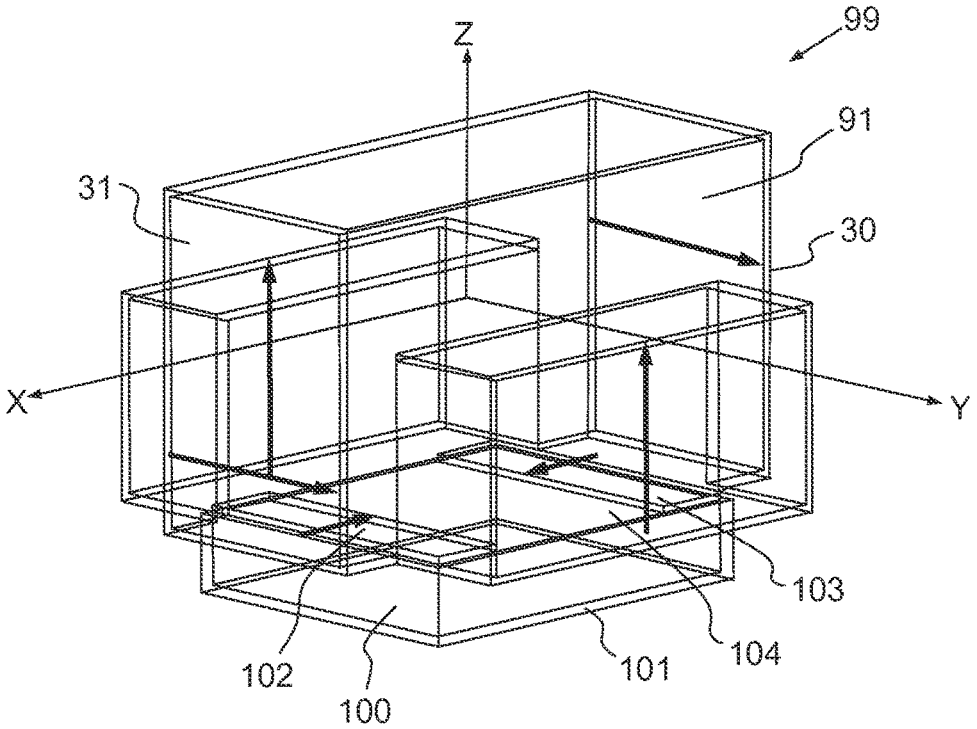
FIG. 13: a perspective diagram of a Tee coupler in the E-plane with embedded junction with four ports comprising an absorbent cavity, according to the invention.

FIG. 6*a* represents an exemplary power splitting array with four output ports comprising two Tee couplers in the E-plane with embedded junction, according to the invention. The power splitter comprises two mutually parallel lateral waveguides 61, 62 and a transverse waveguide 63 coupled perpendicularly to the two lateral waveguides, the coupling between each lateral waveguide and the transverse waveguide being achieved by a Tee coupler in the E-plane with embedded junction according to the invention. Each lateral waveguide 61, 62 is mounted flat with its large sides parallel to the plane XY and the transverse waveguide 63 is mounted edgewise with its large sides perpendicular to the plane XY. The transverse waveguide comprises two ends 63*a*, 63*b* respectively embedded in each lateral waveguide. The power splitter 60 is perfectly symmetric, the two Tee junctions in the E-plane being embedded at the centre of each lateral waveguide at the level of the two ends 63*a*, 63*b* of the transverse waveguide 63. Each lateral waveguide comprises two opposite ends constituting two output/input ports 64, 65, respectively 66, 67, of the power splitter 60, to which can be coupled four radiating elements, each output/input port 64, 65, 66, 67 of the power splitter 60 then constituting an input/output port of a radiating element. The power splitter 60 also comprises a feed port 68 made at the centre of the transverse waveguide, in one of the walls, upper or lower. The feed port 68 can be connected to a feed source, not represented, whose power will be distributed by the power splitter 60 to the four output/input ports 64, 65, 66, 67 so that the four input/output ports of the corresponding radiating elements are fed in phase. In the case where the Tee coupler in the E-plane with embedded junction comprises an external cavity 25 furnished with an absorbent film 26 as represented in FIGS. 4*b* and 13, at the level of each embedded junction, the transverse waveguide 63 comprises a coupling slot 28 made in a peripheral wall and emerging into the external cavity 25. The assembly consisting of the power splitter 60 and radiating elements 69 constitutes a radiating array which can be used as a planar antenna operating under mono-polarization. The four radiating elements 69 connected array-wise by the power splitting array 60 radiate in phase and participate in the formation of one and the same beam 1. It is possible to combine several identical radiating arrays to obtain the formation of several contiguous beams. The radiating arrays can be used alone as direct-radiation antenna or be used in combination with one or more reflectors.

Figure 6B:
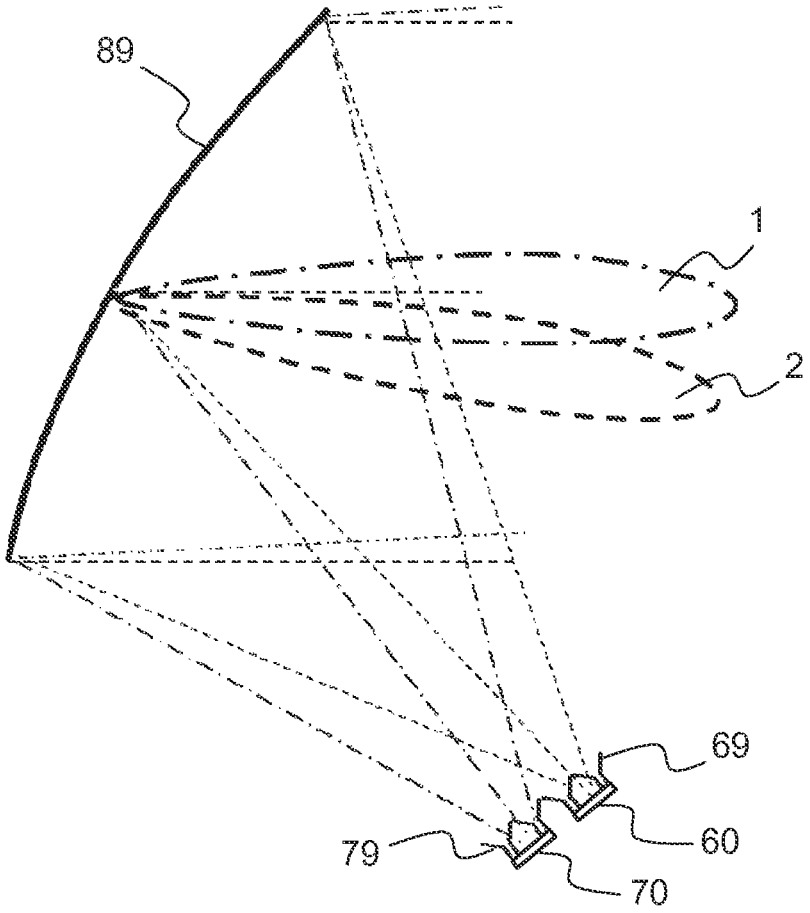
FIG. 6*b*: a sectional schematic view of an antenna comprising two identical power splitters fed by dedicated feed sources and connected to radiating elements, according to the invention.

As represented in the example of FIG. 6*b*, representing a sectional schematic view of an antenna comprising two radiating arrays mounted in the focal plane of a reflector 89, by using several identical power splitters 60, 70 fed by dedicated feed sources, it is possible to achieve several identical planar antennas, which, when used in the guise of primary sources positioned in the focal plane of a parabolic reflector 89, generate contiguous beams. Each beam 1, 2 is formed by four respective radiating elements 69, 79, two of which radiating elements are visible in the sectional view of FIG. 6*b*. The four radiating elements forming each beam 1, 2 are respectively connected to the four output/input ports of a dedicated power splitter 60, 70 and fed in phase and under identical polarization by a central feed source connected to the respective feed port 68, 78 of the corresponding power splitter 60, 70.

Figure 7A:
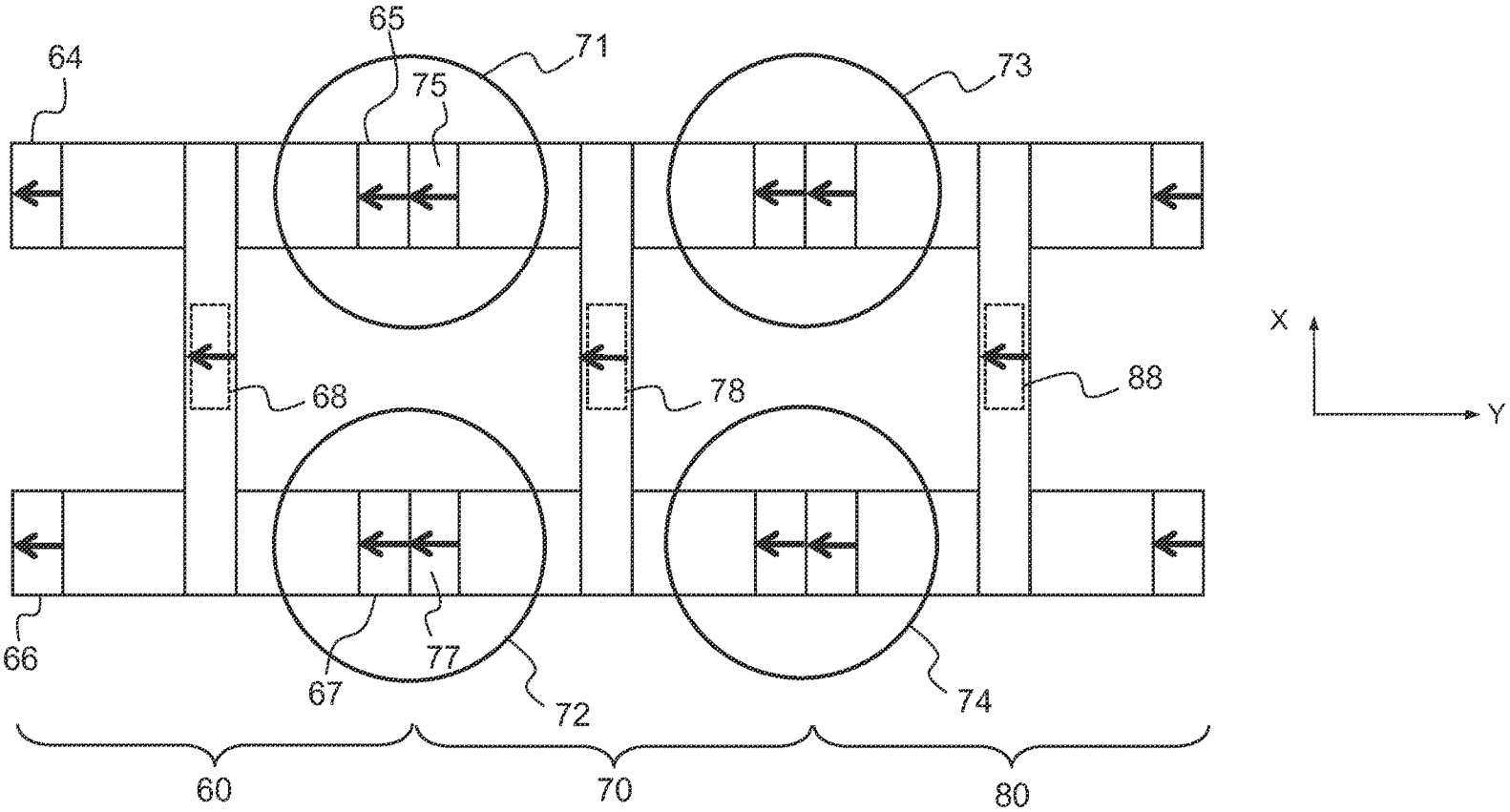
FIG. 7*a*: a schematic view from above of an exemplary power splitting array comprising three splitters with four ports, identical to those of FIG. 6*a*, disposed parallel to one another and linked together by OMTs, according to the invention.
Figure 7B:
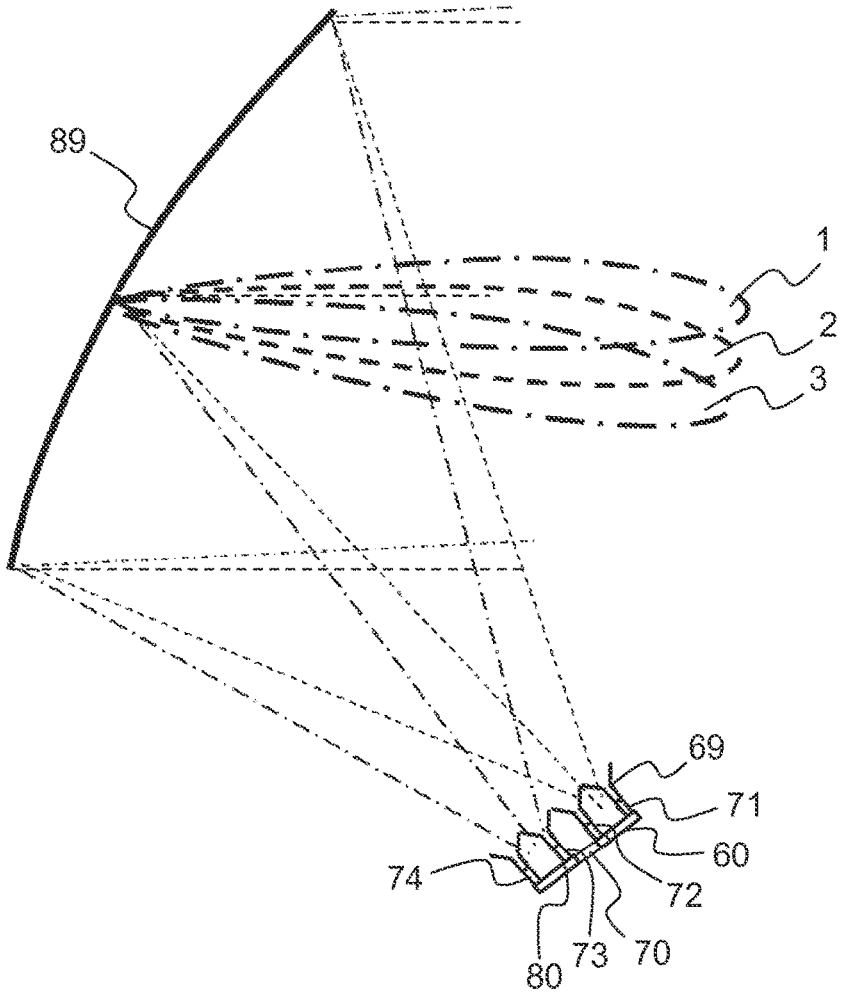
FIG. 7*b*: a sectional schematic view of an exemplary multibeam antenna comprising the power splitting array of FIG. 7*a* coupled to radiating elements and forming primary sources placed in the focal plane of a reflector of the multibeam antenna, according to the invention.
Figure 7C:
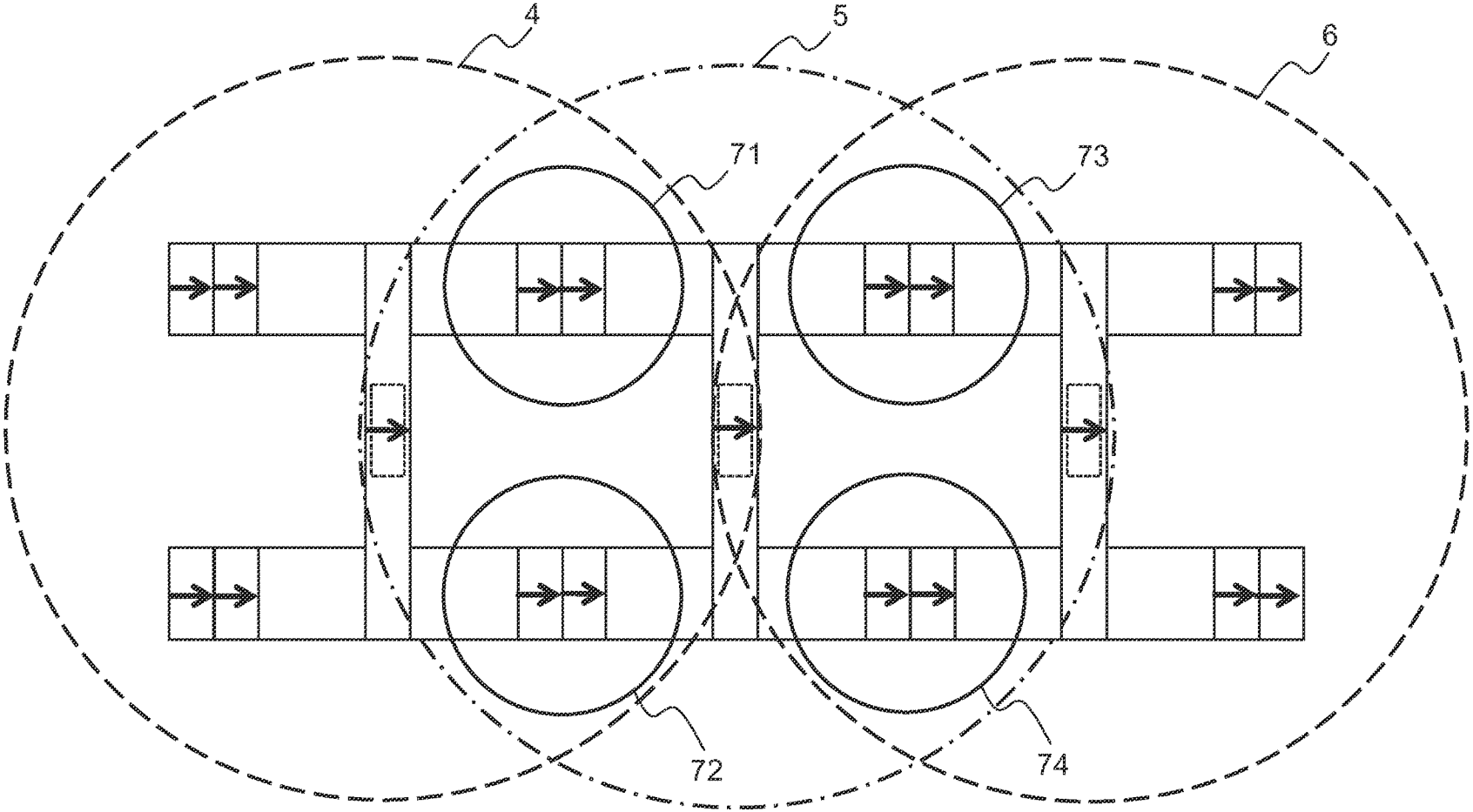
FIG. 7*c*: an exemplary connection of two power splitters by OMTs according to the invention.

FIGS. 7*a* and 7*c* represent an exemplary power splitting array comprising three power splitters 60, 70, 80 each having four output/input ports, according to the invention. The three power splitters 60, 70, 80 are disposed side by side parallel to one another and coupled to polarization diplexers or to orthomode transducers OMT 71, 72, 73, 74 (OMT standing for Orthogonal Mode Transducer) so as to feed radiating elements 69 in two orthogonal polarizations P1, P2. Each power splitter is identical to that of FIG. 6*a* but two adjacent power splitters are dedicated to two different and mutually orthogonal polarizations. The OMTs 71, 72, 73, 74 constitute the input/output ports of the radiating elements 69. This splitting array can be used alone as direct-radiation antenna or, as represented in FIG. 7*b*, this splitting array can be used as an array of primary sources placed in the focal plane of a reflector 89 of a multibeam antenna. Each primary source then consists of four radiating elements coupled in phase and fed in an identical polarization by one of the power splitters and makes it possible to form a beam. Two adjacent power splitters are fed by two mutually orthogonal different polarizations, thereby making it possible to form two orthogonally polarized and spatially offset adjacent beams.

Figure 7D:
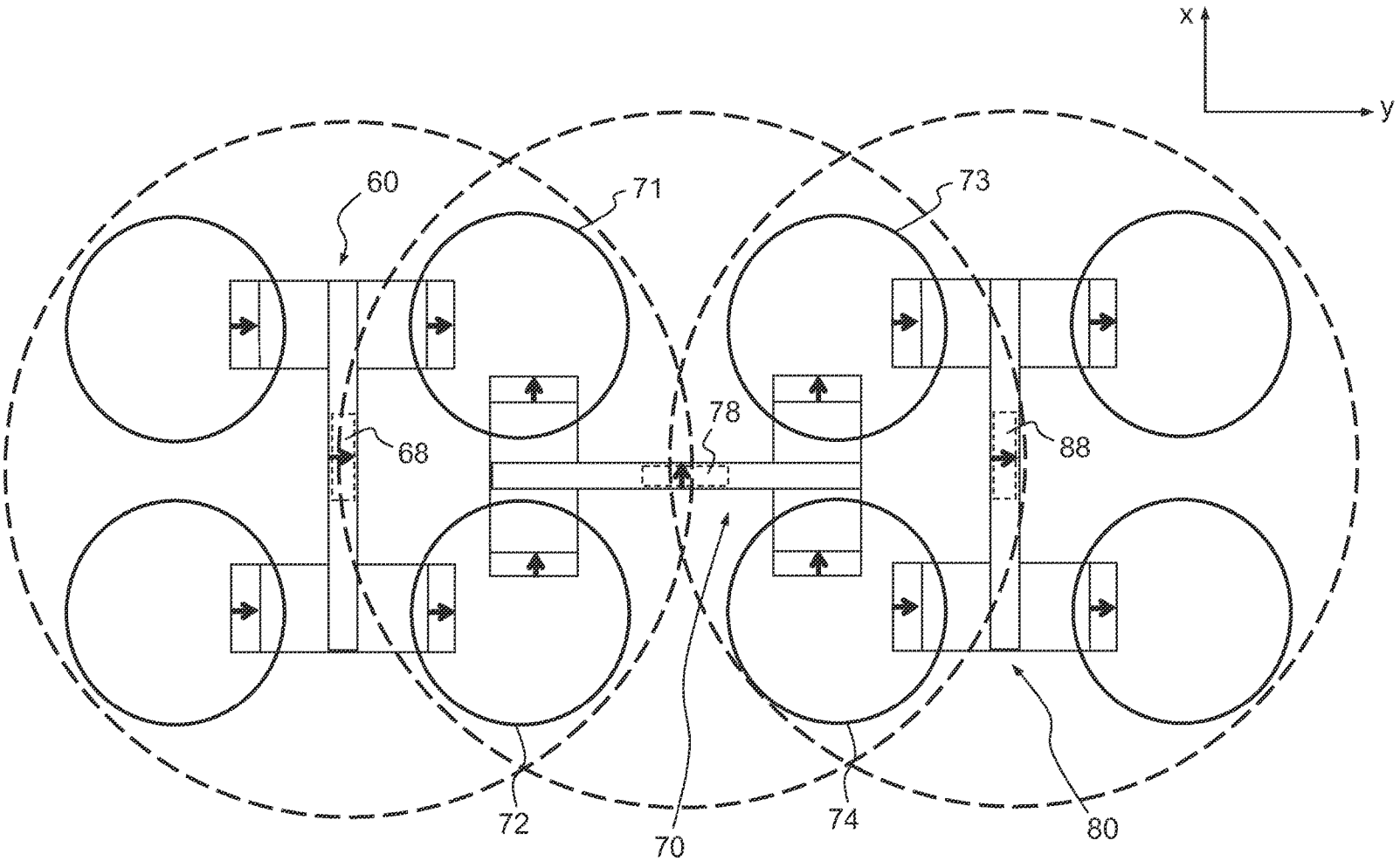
FIG. 7*d*: a schematic view from above of an exemplary power splitting array comprising three splitters with four ports, identical to those of FIG. 6*a*, disposed perpendicular to one another and linked together by OMTs, according to the invention.

Alternatively, in the example of FIG. 7*d*, two adjacent splitting arrays can be disposed perpendicularly to one another. In this second configuration, the adjacent splitting arrays are coupled to OMTs comprising two mutually orthogonal ports.

In these two exemplary embodiments, two adjacent power splitters 60, 70 correspond respectively to two different orthogonal polarizations and make it possible to produce two orthogonally polarized and spatially offset adjacent beams.

In order for the beams 1, 2, 3 produced by the reflector 89 to overlap at a high level as represented in FIG. 7*b*, it is necessary for the radiating apertures 4, 5, 6 of the primary sources to interleave. FIG. 7*c* illustrates the case where the radiating apertures of the primary sources are interleaved along the direction Y. Therefore, according to the invention, the power splitters 60, 70, 80 are disposed alongside one another and linked together pairwise by orthomode transducers OMT 71, 72, 73, 74 with two input ports and an output which is able to deliver two linear or circular orthogonal polarizations. Thus, an OMT making it possible to diplex input signals into two signals of circular polarization can for example be of septum polarizer type.

Figure 8:
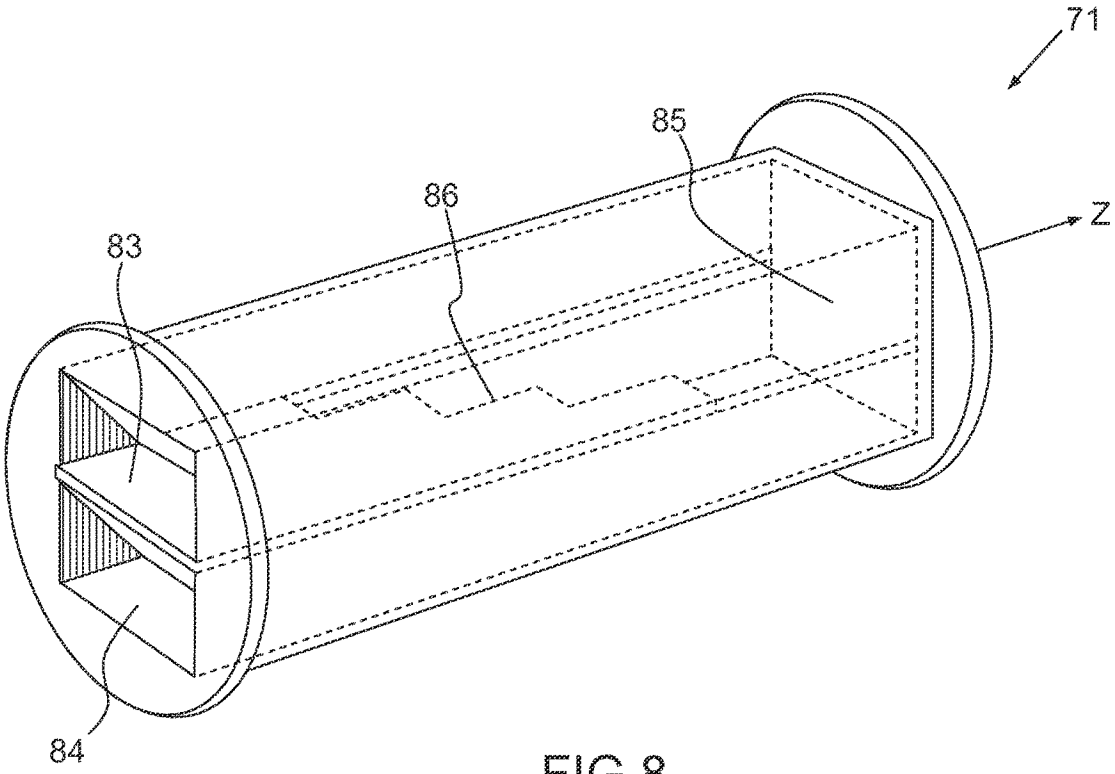
FIG. 8: a longitudinal schematic view of an exemplary septum orthomode transducer, according to the invention.

FIG. 8 illustrates a longitudinal view of an exemplary orthomode transducer of septum polarizer type which can be used in the invention. The OMT of septum polarizer type consists of a waveguide comprising two input ports 83, 84 operating in phase opposition, an output port 85 operating according to two orthogonal polarizations and of a longitudinal internal plate 86, called a septum, separating the two input ports and extending along the direction Z over a part of the length of the waveguide of the OMT. The internal plate 86 of the septum comprises various tiers making it possible to transform an electromagnetic field of linear polarization on input to the septum into an electromagnetic field of right or left circular polarization, on output from the septum, according to the input port excited. The OMT of septum polarizer type operates under circular polarization, but it is also possible to use an OMT operating under linear polarization to produce beams of orthogonal linear polarizations.

When the power splitting array comprises two power splitters 60, 70, the two power splitters can be linked together by way of two OMTs 71, 72, the output port 85 of each OMT being intended to be connected to a radiating element 69. In this case, the two input ports 83, 84 of each OMT 71, 72 are respectively connected to two output ports 65, 75, respectively 67, 77, belonging to each of the two power splitters. When the splitting array comprises more than two power splitters, all the power splitters can be linked together by way of several OMTs 71, 72, 73, 74, each OMT being coupled to two output ports of two adjacent power splitters 60, 70 or 70, 80. The transverse waveguide of each power splitter comprises an input port 68, 78, 88 which can be fed by a dedicated feed source. For example, the input ports 68, 78, 88 of three pairwise adjacent power splitters 60, 70, 80 can be fed with a TE10 mode. Each OMT connected to two adjacent splitters 60, 70, 80 will produce two signals under orthogonal circular polarizations. According to the input port of the OMT, the circular polarization produced on output from the OMT will be right or left. Thus, the OMTs connected to a first power splitter can be oriented so as to produce signals in phase and having one and the same first polarization P1 and the OMTs connected to a second power splitter can be oriented so as to produce signals in phase and having one and the same second polarization P2 orthogonal to P1. The output ports 85 of each OMT 71, 72, 73, 74 can then be respectively coupled to respective radiating elements, for example horns or Fabry-Perot cavities, so as to obtain radiating arrays able to form beams in the first polarization P1 or in the second polarization P2. The radiating arrays obtained can be used in the guise of primary source of a parabolic reflector 89 to form adjacent beams 1, 2 having two different colours, the two colours corresponding respectively to the polarizations P1 and P2.

Figure 9:
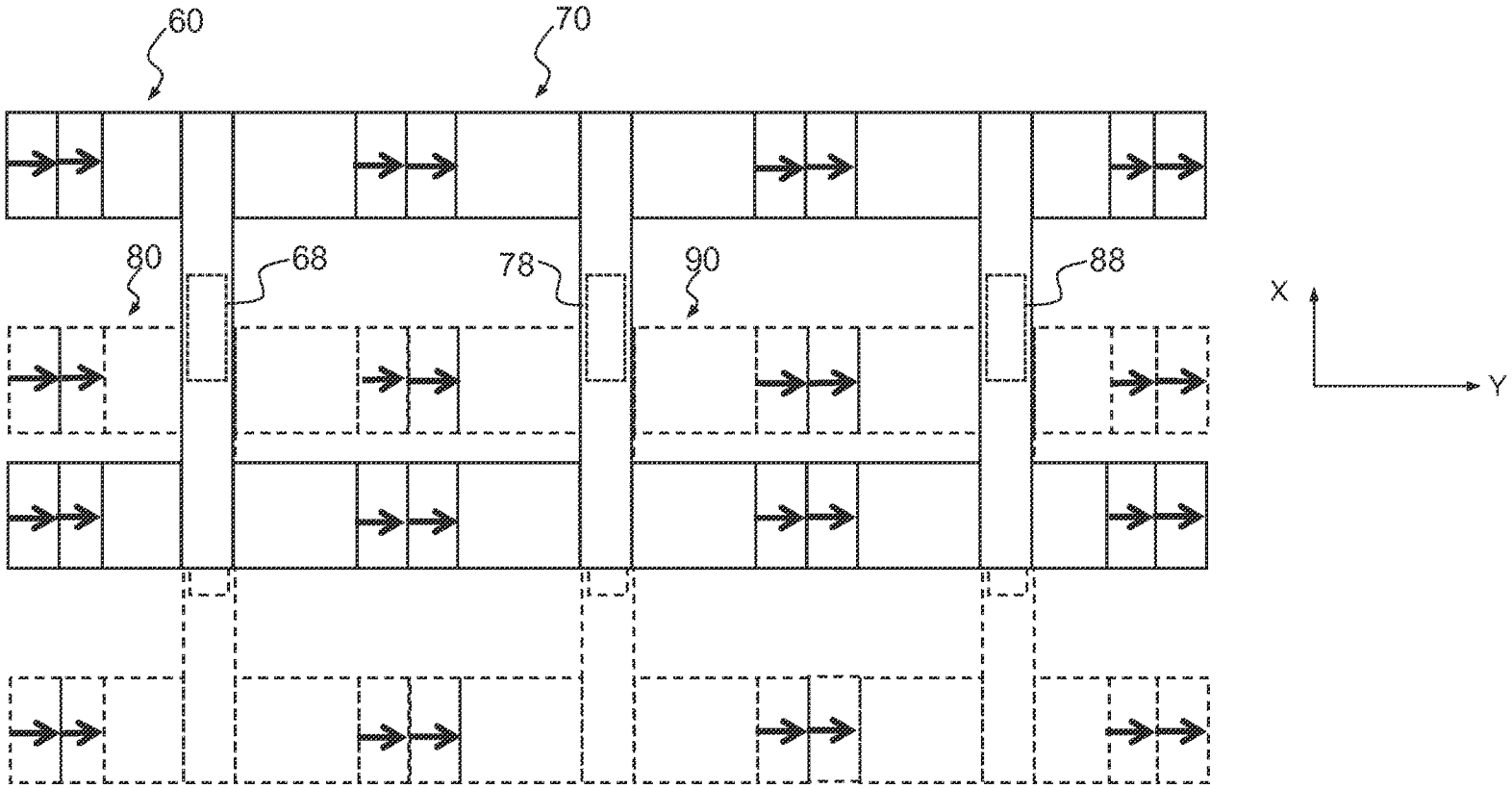
FIG. 9: a diagram from above of a first exemplary splitting array comprising several power splitters linked together pairwise along two directions of a plane, according to the invention.

In the examples represented in FIGS. 7*a*, 7*c* and 7*d*, the splitting arrays are linked to one another along a single direction Y, thereby making it possible to achieve interleaved beams extending in a single direction. Likewise, with a splitting array comprising several power splitters 60, 70, 80, 90 linked together pairwise along two directions of a plane XY as represented in the exemplary splitting array of FIG. 9, and by feeding the radiating elements of the adjacent splitters with four different colours, it is possible to form beams which are interleaved along two directions of a plane, the adjacent beams having different colours. The four different colours correspond to four pairs of different frequency and polarization values (F1, P1), (F2, P1), (F1, P2), (F2, P2). Therefore, it is necessary for each radiating element to be able to be fed by four different colours originating from four different power splitters.

According to one embodiment, each radiating element 69 can be fed by four different colours by using, during transmission, a power combining means connected between each output port of a power splitter and each input port 83, 84 of an OMT 71, 72. On reception, the power combining means operates as a power dividing means, the output ports of the power splitter become input ports and conversely, the input ports 83, 84 of the OMT 71, 72 become output ports. The operation of an antenna during reception being the converse of that during transmission, in the subsequent description, the qualification of the various ports corresponds to operation in transmission.

Figure 10A:
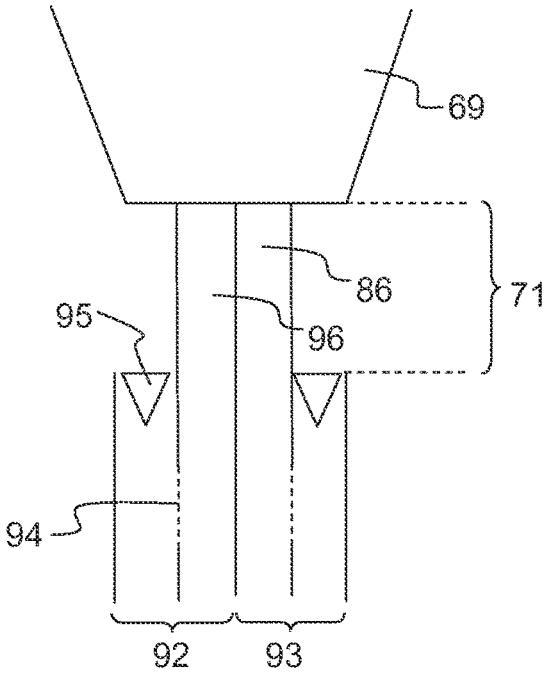
FIG. 10*a*: a longitudinal sectional diagram of an exemplary directional coupler coupled to a radiating element by way of an OMT, according to the invention.

The power combining/dividing means 92, 93 can be achieved in various ways. In the example of FIG. 10*a*, two power combining/dividing means 92, 93 are represented, each power combining/dividing means being achieved by a directional coupler using waveguides with two output ports. In FIG. 10*a*, the directional coupler comprises two input waveguides coupled together at an end by holes 94 made in the internal metallic wall separating the two waveguides, but many other variants exist and can be used. This coupler with holes comprises an insulated port 95 connected to a resistive load and an output port 96 connected to an input of the OMT 71. However, such a power combiner/divider attenuates the signals received when it operates in reception. These attenuations can be compensated by adding low noise amplifiers between the power splitters and the OMTs.

Figure 10B:
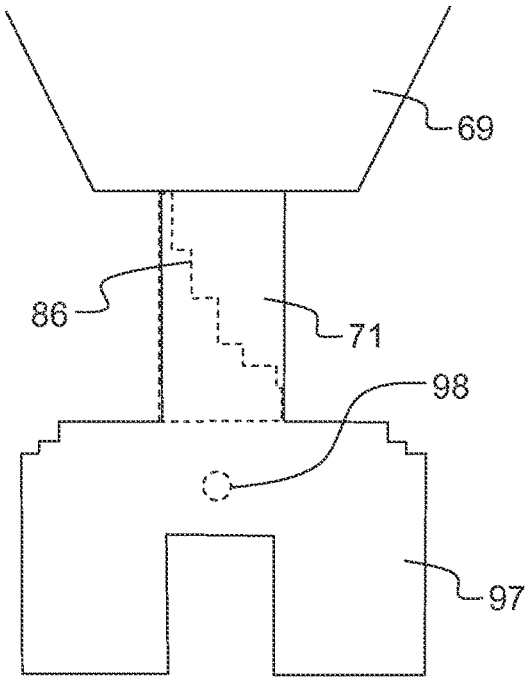
FIG. 10*b*: a longitudinal sectional diagram of an exemplary ferrite circulator coupled to a radiating element by way of an OMT, according to the invention.

Alternatively, according to another embodiment, the combiner/divider can be transformed into a circulator 97 for example by inserting a ferrite washer 98 into the combiner/divider as represented in the example of FIG. 10*b*.

Figure 11:
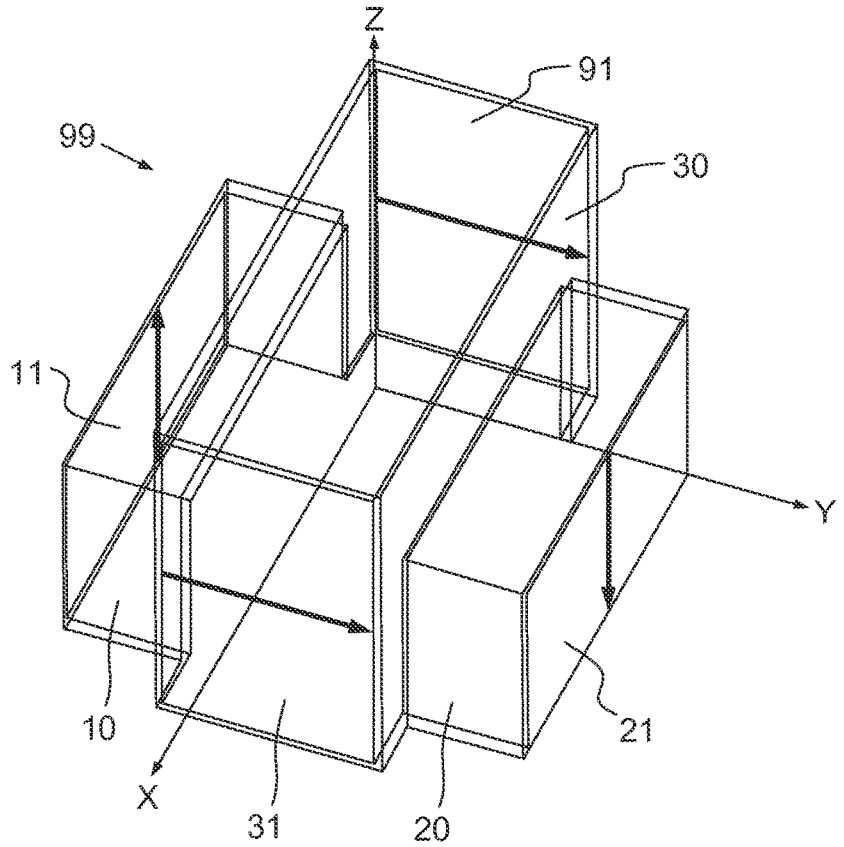
FIG. 11: a perspective diagram of a Tee coupler in the E-plane with embedded junction with four ports, according to the invention.
Figure 12:
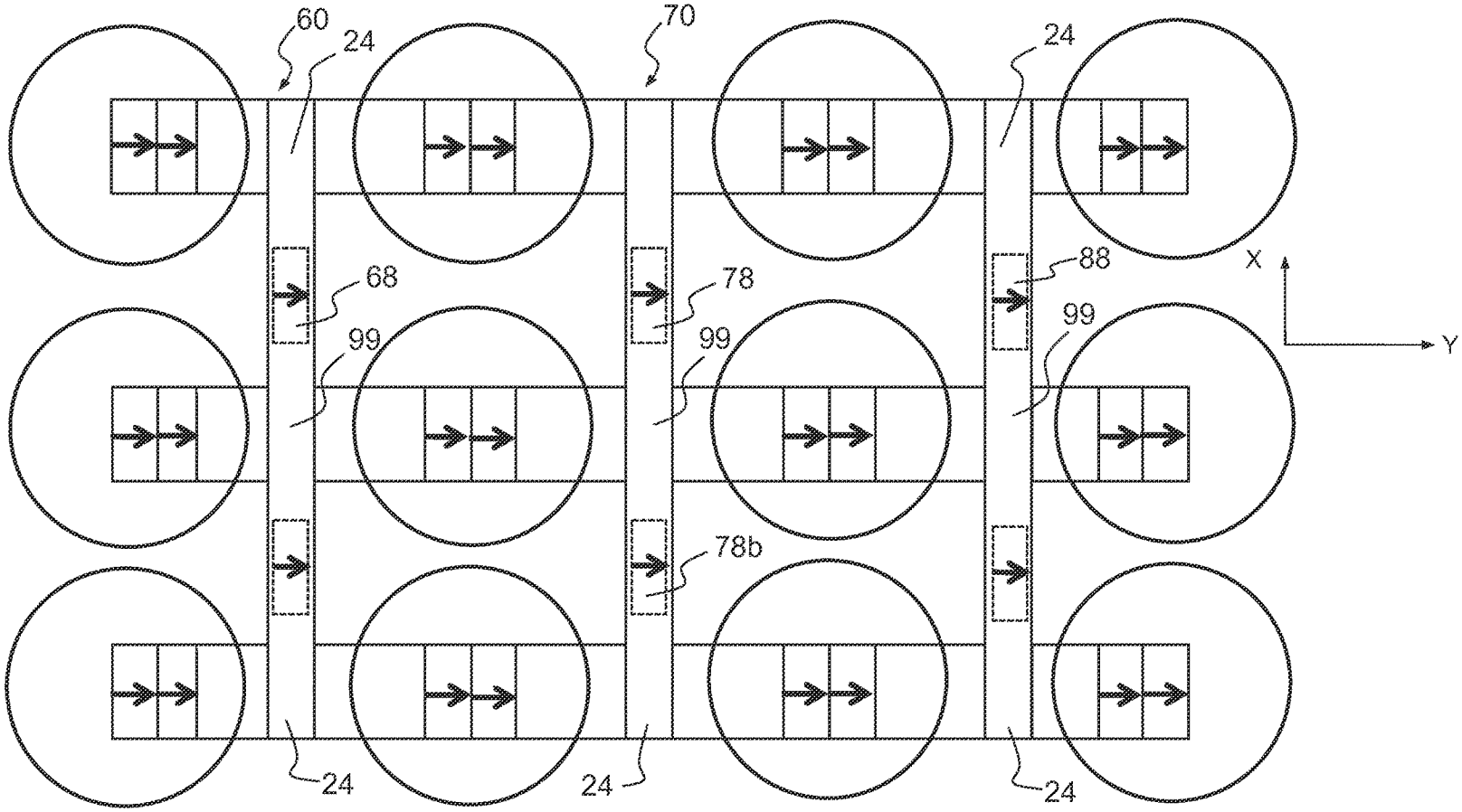
FIG. 12: a diagram from above of a second exemplary splitting array comprising several power splitters linked together pairwise along two directions of a plane, according to the invention.

Alternatively, according to another embodiment of the invention, the power combining/dividing means can consist of a Tee coupler in the E-plane with embedded junction with four ports. As represented in FIG. 11, according to the invention, the Tee coupler in the E-plane with embedded junction 99 comprises two lateral waveguides 10 and 20 mounted flat on their large side and a central waveguide 30 mounted edgewise on its small side, the central waveguide 30 being embedded between the two lateral waveguides 10, 20 like the structure of the Tee coupler with embedded junction represented in FIG. 4. This Tee coupler in the E-plane with embedded junction also comprises two output ports 11, 21 situated at the two ends of the two lateral waveguides and a first input port 31 situated at a first end of the central waveguide 30. Furthermore, this Tee coupler in the E-plane with embedded junction comprises a second additional input port 91 situated at the second end of the central waveguide 30, opposite the first input port 31. The two input ports 31, 91 are oriented along the direction X perpendicular to the direction Y of the two output ports 11, 21. In this case, when the two ports 11, 21 of the lateral waveguides 10, 20 of the coupler with embedded junction with four ports are fed in phase opposition, then the signals separate equally to the two ports 31, 91 of the central waveguide 30. This then makes it possible to double the number of output ports of the corresponding power splitter and therefore the number of feed input ports for the radiating elements which are connected thereto. It is then possible to achieve a beamforming antenna interleaved along two directions of a plane XY by achieving a power splitter comprising Tee couplers in the E-plane with embedded junction with four ports along two directions of a plane as represented schematically in the example of FIG. 12. The Tee couplers in the E-plane with embedded junction with four ports 99 are inserted into certain power splitters instead of the Tee couplers in the E-plane with embedded junction with three ports 24, thereby making it possible to ensure the link with an adjacent power splitter along the direction X parallel to the longitudinal axis of the central waveguide of each power splitter. The fourth port of each coupler 99 situated at an end of the central waveguide of a power splitter is available and can be connected directly to the central waveguide of an adjacent power splitter. In this manner, two splitters which are adjacent along the direction X parallel to the longitudinal axis of the central waveguide of each power splitter, linked together by a coupler with four ports 99, share a lateral waveguide, thereby making it possible to interleave the corresponding radiating apertures along the direction X. It is then possible to form beams which are interleaved along two directions of a plane, the adjacent beams having different colours. The four different colours correspond to four pairs of different frequency and polarization values (F1, P1), (F2, P1), (F1, P2), (F2, P2). In the same manner as for the splitter of FIG. 9, the embedded junction with four ports 99 divides the signals received by the radiating elements, and routes them to the output ports 78, 78*b* when it operates in reception. These attenuations can be compensated by adding low noise amplifiers between the power splitters and the OMTs.

For use in transmission, the couplings between the two input ports 31, 91 of the Tee coupler in the E-plane with embedded junction are significant and result in significant couplings at the level of the feed input ports 68, 78, 88 of the power splitter, thereby requiring the employment of isolators at this level. Furthermore, to limit this inter-port coupling, and decrease the losses in power in these isolators, it is also possible to include a ferrite washer at the centre of the embedded junction of the coupler. The coupling between the two input ports 31 and 91 is then appreciably modified, and the signals transmitted towards the input ports 31 or 91 of the Tee coupler are then fully routed, separating equally towards the two output ports 11 and 21.

The Tee coupler 99 with embedded junction with four ports represented in FIG. 11 is sensitive in terms of matching to the phase coherence of the incident signals entering the ports 21 and 11 when the splitter operates in reception, or entering the ports 31 and 91 when the splitter operates under transmission. If the incident signals are no longer in phase opposition, as is the case for example for the signals received by the radiating elements for an incident wave with a direction not normal to the surface of the array, then the signals are slightly unbalanced in phase. This may result in a mismatching of the Tee coupler with four ports 99, injurious to the radiating pattern of the radiating array. In this case, as represented in FIG. 13, the Tee coupler with embedded junction with four ports 99 can comprise a cavity 100 at the bottom of which is deposited an absorbent film 101. The absorbent cavity can be made for example, under the lower wall 104 of the central waveguide 30 of the coupler 99 and is fed by two longitudinal slots 102, 103 made in the said lower wall 104.

Although the invention has been described in conjunction with particular embodiments, it is very obvious that it is in no way limited thereto and that it comprises all the technical equivalents of the means described as well as their combinations if the latter enter within the framework of the invention.

The invention claimed is:

1. A power splitter comprising:

two mutually parallel lateral waveguides, each having a rectangular cross-section with a large side; and a transverse waveguide having a rectangular cross-section with a small side, the transverse waveguide comprising two opposite ends connected respectively to the two lateral waveguides, wherein the lateral waveguides are oriented along a Y-direction with the large sides mounted flat and parallel to an XY-plane, wherein the transverse waveguide is oriented along an X-direction and mounted with the small side parallel to the XY-plane, and wherein each of the lateral waveguides is coupled to the transverse waveguide by a tee coupler in an E-plane with an embedded junction, each of the two ends of the transverse waveguide being embedded respectively in a center of the lateral waveguides.

2. The power splitter of claim 1, wherein each of the two lateral waveguides comprises two opposite ends, collectively comprising four input/output ports, and the transverse waveguide comprises a central feed port.

3. A radiating array comprising:

the power splitter of claim 2; and four radiating elements coupled respectively to the four ports of the power splitter.

4. A beamforming antenna comprising the radiating array of claim 3.

5. The beamforming antenna of claim 4, further comprising:

two power splitters disposed parallel to one another, linked together, and extending along the Y-direction of the lateral waveguides of the power splitters; and wherein the radiating array includes radiating elements coupled to the power splitters by orthomode transducers.

6. The beamforming antenna of claim 4, further comprising:

two power splitters disposed perpendicular to one another and linked together by orthomode transducers, wherein the radiating array includes radiating elements coupled respectively to output ports of the orthomode transducers.

7. The beamforming antenna of claim 4, further comprising:

a reflector; and two adjacent identical radiating arrays mounted in front of the reflector, the two adjacent radiating arrays being dedicated to two mutually orthogonal different polarizations.

8. The beamforming antenna of claim 5, further comprising:

four power splitters; and power combining/dividing means connected between ports of the power splitters and input ports of the orthomode transducers, the power splitters being linked pairwise along orthogonal directions of the XY-plane.

9. The beamforming antenna of claim 8, wherein the power combining/dividing means comprises a plurality of the tee couplers in the E-plane with an embedded junction having four ports, the four ports comprising two input ports oriented along the X-direction and two output ports oriented along the Y-direction, wherein three of the four ports link the lateral waveguides to the transverse waveguide of a first of the four power splitters along the Y-direction, and wherein one of the four ports link the transverse waveguide of the first power splitter to a transverse waveguide of a second of the four power splitters along the X-direction, the second power splitter being adjacent to the first power splitter.

10. A power splitter comprising:

two mutually parallel lateral waveguides, each having a rectangular cross-section with a large side; and a transverse waveguide having a rectangular cross-section with a small side, the transverse waveguide comprising two opposite ends connected respectively to the two lateral waveguides, wherein the lateral waveguides are oriented along a Y-direction with the large sides mounted flat and parallel to an XY-plane, wherein the transverse waveguide is oriented along an X-direction and mounted with the small side parallel to the XY-plane, wherein each of the lateral waveguides is coupled to the transverse waveguide by a tee coupler in an E-plane with an embedded junction, each of the two ends of the transverse waveguide being embedded respectively in a center of the lateral waveguides, wherein each of the two lateral waveguides comprises two opposite ends, collectively comprising four input/output ports, and the transverse waveguide comprises a central feed port, and wherein the transverse waveguide comprises an external cavity at a level of each embedded junction, the external cavity including an absorbent film and a coupling slot extending into the external cavity.

* * * * *